US006125606A

United States Patent [19]

Larsson

[11] Patent Number: 6,125,606

[45] Date of Patent: Oct. 3, 2000

[54] BEAM CONSTRUCTION IN CEILINGS OF CLEAN AIR ROOMS

[75] Inventor: Bertil Larsson, Tyresö, Sweden

[73] Assignee: ABB Fläkt AB, Stockholm, Sweden

[21] Appl. No.: 09/269,934

[22] PCT Filed: Oct. 8, 1997

[86] PCT No.: PCT/SE97/01679

§ 371 Date: Apr. 8, 1999

§ 102(e) Date: Apr. 8, 1999

[87] PCT Pub. No.: WO98/16702

PCT Pub. Date: Apr. 23, 1998

[30] Foreign Application Priority Data

Oct. 17, 1996 [SE] Sweden ..... 9603816

[51] Int. Cl.[7] ..... E04C 2/38

[52] U.S. Cl. ..... 52/726.2; 52/236.9; 52/730.5; 52/655.1; 52/656.9; 403/297; 403/170

[58] Field of Search ..... 52/726.2, 729.2, 52/730.4, 730.5, 730.6, 731.2, 731.3, 737.6, 236.9, 655.1, 656.9; 403/297, 170

[56] References Cited

U.S. PATENT DOCUMENTS

| | | | |
|---|---|---|---|
| 2,008,557 | 7/1935 | Lambert | 52/731.2 |
| 3,332,179 | 7/1967 | Toti | 52/92.2 |
| 3,742,674 | 7/1973 | Lang . | |
| 3,749,432 | 7/1973 | Janssen | 52/476 |
| 3,848,385 | 11/1974 | Tompson . | |
| 4,875,311 | 10/1989 | Meyers | 52/90.1 |
| 5,291,705 | 3/1994 | Dickerson | 52/200 |
| 5,396,748 | 3/1995 | Rogers | 52/664 |
| 5,727,356 | 3/1998 | Ensinger et al. | 52/717.02 |
| 5,802,800 | 9/1998 | Meyers | 52/731.2 |
| 5,806,268 | 9/1998 | Koller | 52/653.1 |
| 5,974,758 | 11/1999 | Pielmeier | 52/656.2 |

FOREIGN PATENT DOCUMENTS

| | | |
|---|---|---|
| 2125637B2 | 1/1975 | Germany . |
| 3500258C2 | 2/1990 | Germany . |
| 456261B | 9/1988 | Sweden . |

*Primary Examiner*—Christopher T. Kent
*Assistant Examiner*—Jennifer I. Thissell
*Attorney, Agent, or Firm*—Burns, Doane, Swecker & Mathis, L.L.P.

[57] ABSTRACT

A beam construction for ceilings in clean rooms, comprising first (1) and second (2) beams. The first and second beams are arranged essentially horizontally and perpendicularly to each other and have longitudinal ducts (7) for receiving a liquid or viscous sealant. In order to facilitate mounting and increase the flexibility of the beam construction, a transition piece (12) is arranged between two beam elements (1*a,* 1*b*) which are arranged successively in the longitudinal direction, thereby forming an opening (14) in at least one side-limiting duct wall (6) of the first beam (1). A second beam (2) is arranged sealingly against the transition piece (12) and the first beam elements (1*a,* 1*b*) arranged on each side thereof, such that the ends of the duct walls (6) of the second beam encompass the thus-formed opening (14).

24 Claims, 2 Drawing Sheets

BEAM CONSTRUCTION IN CEILINGS OF CLEAN AIR ROOMS

INTRODUCTION

This invention relates to a beam construction for ceilings in clean rooms, comprising first and second beams, which are arranged essentially horizontally and perpendicularly to each other and have longitudinal ducts for receiving a liquid or viscous sealant, said ducts at least partly being formed of longitudinal walls arranged on the beams, one wall defining the duct downwards and two walls defining the duct sideways.

BACKGROUND ART

SE 456,261 discloses such a known beam construction. This beam construction has first and second horizontally arranged beams, which are joined perpendicularly to each other, thereby forming a frame where the first and second beams are joined in T- or X-shaped joints. The frame is suspended from the ceiling in a surrounding room and is used to support filter elements and blank panels which define the clean room below the clean room ceiling. Also other equipment such as sprinkler nozzles, lighting fittings and airflow-guiding sheets can be fixed in the frame or suspended therefrom. The first and the second beams have on their upper sides longitudinal ducts for receiving a liquid or viscous gel acting as sealant. The ducts are formed of a space, which is formed between a web portion, an axially extending projection and, opposing the projection, an edge portion of the first and second beams. The beams are of symmetrical cross-section and have two such longitudinal ducts, one on each side of a vertical symmetry line of the cross-section.

The filter elements and the blank panels are, along their edges, provided with knives, which after mounting on the frame penetrate into the sealant in the ducts. This results in a ceiling construction which is completely tight from the viewpoint of contamination.

TECHNICAL PROBLEMS

The beam construction disclosed in SE 456,261 suffers from a number of drawbacks in respect of the mounting of the clean room ceiling and the flexibility of the ceiling after mounting.

For the ceiling to be completely tight, the ducts containing the sealant must extend continuously without interruption along all the first and second beams in a coherent ceiling portion. The ducts along the first beams extending in one direction must thus be connected with the ducts along the second beams extending perpendicularly to the first ones. This is achieved in the beam construction according to SE 456,261 by openings in the form of milled recesses being arranged in the edge portions of the first beams. These openings are arranged opposite to the end of the second beams, such that the ducts along the first beams, via the opening and the open end of the second beams, are in contact with the ducts along the second beams.

Since the openings in the edge portions of the first beams must be made by milling, it is very difficult to make the openings in situ during mounting of the ceiling. In practice, this implies that all first beams must be made to measure and be finally machined before delivery to the mounting location. This in turn implies that the positions of the second beams relative to the first beams are determined in advance in the positions of the first beams where the openings are formed. Unforeseen obstacles, if any, on the mounting location, such as columns, amended plan drawings or the like, may thus result in the prefabricated first beams not being usable. This causes not only unnecessary refusal of first beams, but the mounting work must be interrupted until new prefabricated first beams have been manufactured and delivered. It goes without saying that this causes considerable extra expenses.

Like in the mounting of new clean room ceilings, the beam construction according to SE-456,261 also causes considerably reduced flexibility when rebuilding the clean room. Since the openings are made in the first beams, it is not possible to remove or move a transverse second beam unless the first beam is exchanged. The removal of a second beam in fact results in the opening being uncovered, thereby making it possible for the liquid or viscous sealant to escape. Attempts at plugging up the openings in the first beams have not been successful. Even if this had been the case, there is still the difficulty of milling, in situ or above the clean room, a new opening in the position to which the second beam is to be moved. Flexibility when rebuilding clean rooms is a more and more important property since altered manufacturing techniques and adjusted flows of material, for instance when manufacturing semiconductors, often lead to rebuilding of the clean room that is used for the manufacture.

The problems described above may seem insignificant and simple, but for a long time they have incurred considerable additional expense in the building of clean rooms, without an acceptable solution being found.

The object of the present invention therefore is a beam construction for clean room ceilings, which ensures perfect tightness and at the same time offers greater flexibility when mounting and rebuilding the ceiling.

SOLUTION

According to the invention, this object is achieved by a beam construction of the type described above, wherein the opening in a joint between the first and second beams is accomplished by a transition piece, which at least partly has no side-limiting duct wall and, the milling operation for making the opening is thus fully obviated. When mounting clean room ceilings, it will thus be possible to utilise fully standardised first beams.

When the position of a transverse second beam has been determined relative to a first beam, the first beam is easily cut by means of a saw, whereupon a transition piece is joined to the cut first beam and a longitudinally subsequent first beam. Then the transverse second beam is arranged such that its end connects tightly around the opening formed.

Thus, the only operation required is cutting, which can be carried out without difficulty on the location of mounting. Also when rebuilding the clean room, the beam construction according to the invention offers essentially increased flexibility. When a second beam is to be moved, it is easy to replace the opening-creating transition piece with a transition piece provided with longitudinal side-limiting duct walls. In this manner, the previous opening is eliminated and a new opening can be made by cutting an existing first beam in a suitable position and there insert a transition piece without a side-limiting duct wall. In this fashion the entire clean room ceiling is rebuilt without necessitating milling operations or the exchange of existing beams.

The transition piece can be provided with a longitudinal side-limiting duct wall on one side, in which case a T-shaped joint forms when a second beam is arranged in abutment with the side that, at least partly, has no side limitation. Alternatively, the transition piece may, at least partly, have no side limitations on both sides. An X-shaped joint is then formed when two second beams are mounted, one on each side of the transition piece.

The transition piece is suitably made of an extruded material. This results in a very cost-effective manufacture of the transition piece. The transition piece can also be made of many different materials, such as steel and plastic. However, it is preferably made of the same material as the first and second beams, which are suitably made of extruded aluminium.

For joining the transition piece to the surrounding first beams, one or more sectional elements can be used. These can be inserted into axially extending grooves in the transition piece and in the surrounding first beams. To impart good strength and flexural rigidity to the joint when subjected to vertical load, the sectional element is suitably longer than the transition piece, such that one and the same sectional element extends from a distance into a first beam, through the transition piece and a distance into the subsequent first beam.

The sectional element is suitably axially displaceable in the groove. By moving the sectional element away from the joint between the first beams and the transition piece, it is easy to replace a transition piece or a first beam, without the length of the joined first beam having to be increased temporarily during the replacement operation. This property, which is usually referred to as non-progressive construction, is of great value since it allows replacement of certain ceiling elements without necessitating dismounting of adjoining parts. The best strength in combination with flexibility is obtained if the sectional element is arranged axially fixed in the normal use of the clean room, but axially displaceable during mounting and rebuilding.

The second beams are suitably joined to the first beams with the aid of locking means, which are axially fixed to the ends of the second beams and have jaws cooperating with the groove which extends axially in the transition piece. As a result, a simple and robust connection between the first and second beams is obtained, which makes the beam construction nonprogressive also in the direction parallel to the second beams.

Further the jaws can also cooperate with a sectional element arranged in the groove. This results in additionally improved strength of the joint. The sectional element is fixed axially when the second beam is mounted and is released axially when the second beam is released.

A special advantage obtained with the beam construction according to the invention is that only four different standardised elements constitute the entire system. These elements are the first and second beams which may be identical, the transition piece, the sectional element and the locking means. By cutting the first and second beams to suitable lengths and joining them by means of transition pieces, sectional element and locking means, frames for plane clean room ceilings of all conceivable variants can be built.

DESCRIPTION OF THE FIGURES

Exemplifying embodiments of a beam construction according to the invention will be described below with reference to the accompanying drawings.

Figure 1:
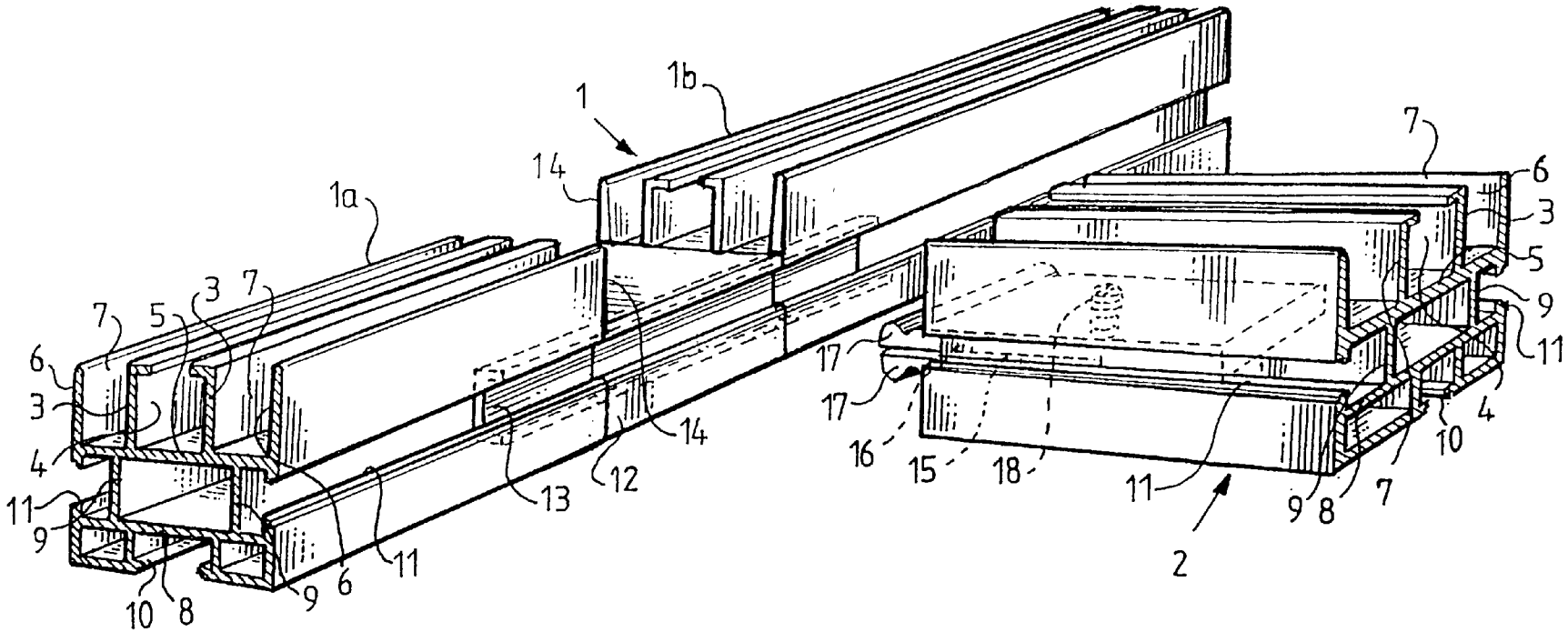
FIG. 1 is a schematic perspective view of a part of a beam construction according to an embodiment of the invention. For better clarity, the beam construction has been dismounted.

The beam construction part shown in FIG. 1 comprises a first beam 1 and a second beam 2. The first beam 1 comprises two first beam elements 1*a,* 1*b,* which are arranged one after the other in the longitudinal direction of the first beam 1. Both the first 1 and the second 2 beam have two protruding projections 3, which together form a T groove 4 extending in the longitudinal direction of each beam 1, 2 and adapted to receive suspension means (not shown) for suspending the beam construction. The beams 1, 2 further have a first web portion 5 and two side-limiting duct walls 6. The projections 3, the web portions 5 and the side-limiting duct walls 6 form two longitudinal ducts 7 on the respective beams 1, 2. The ducts 7 are adapted to receive a viscous sealant, such as vaseline.

The lower parts of the two beams 1, 2 have a second web portion 8 extending in parallel with the first web portion 5. The two web portions 5, 8 are interconnected by means of two parallel and spaced-apart connecting portions 9. The beams 1, 2 further have one downwardly 10 and two laterally directed T grooves 11. The first 1 and the second 2 beams are of the same cross-section in the shown example.

The two first beam elements 1*a,* 1*b* are arranged one at each end of a transition piece 12. The transition piece 12 is of a cross-section corresponding to the cross-section of the beams 1, 2 from the first web portion 5 downwards. However, the transition piece 12 has no equivalence to the projections 3 and side-limiting duct walls 6 of the beams. The two first beam elements 1*a,* 1*b* are joined to the transition piece 12 by means of two sectional elements 13, which are arranged in the T grooves 11 arranged along the two first beam elements and the transition piece 12 and directed sideways. The sectional elements 13 are longer than the transition piece 12, such that they each project a distance into the first beam elements 1*a,* 1*b*. Owing to the absence of side-limiting duct walls of the transition piece 12, the ducts 7 of the first beam 1 each have an opening 14 facing the respective sides.

The second beam 2 is arranged perpendicularly to the first beam 1, opposite to the transition piece 12. A locking means 15 is arranged in that end of the second beam 2 which faces the transition piece 12. The locking means 15 is detachably fixed in the longitudinal direction of the second beam 2. The locking means 15 has two legs 16 each having a jaw 17 projecting from the end of the second beam and cooperating in its mounted state with the T groove 11 in the transition piece 12. The jaws 17 can be made to move away from each other by separating the two legs from each other by means of a screw 18. The screw 18 is accessible for operation through a hole (not shown), which is formed in the upwardly directed T groove 4 of the second beam 2.

In its mounted state, the second beam 2 abuts against the first beam 1. The length of the transition piece 12 is slightly smaller than the width of the second beam 2. As a result, the end surfaces of the side-limiting duct walls 6 of the second beam will abut against the outside of the side-limiting duct walls 6, facing the second beam, of the two first beam elements 1*a,* 1*b*. The first web portion 5 and side-limiting duct walls 6 of the second beam thus surround the opening 14 so as to form a tight duct connection between the ducts 7 of the first 1 and the second 2 beams. The Figure shows only one second beam 2, but it will be understood that a corresponding second beam is arranged in the same way also on the opposite side of the first beam and surrounds the opening 14 formed on this side. In this way, an X-shaped joint forms between the first and second beams, thereby interconnecting the ducts 7 in the first 1 and second 2 beams. It will also be understood that the opposite ends of the second beams 2 can be joined in the same way to other first beams. By thus joining several first and second beams, a frame with unbroken ducts 7 for receiving the viscous sealant is obtained. When the beam construction is mounted and the ducts are filled with sealant, the filter elements, blank panels and other elements (not shown) which are to be supported by the beam construction will be mounted from above. These elements are along their circumference provided with continuous knives, which after mounting project downwards under the surface of the sealant. In this way a tightness which from the viewpoint of contamination is good, is ensured along the entire ceiling construction.

Figure 2:
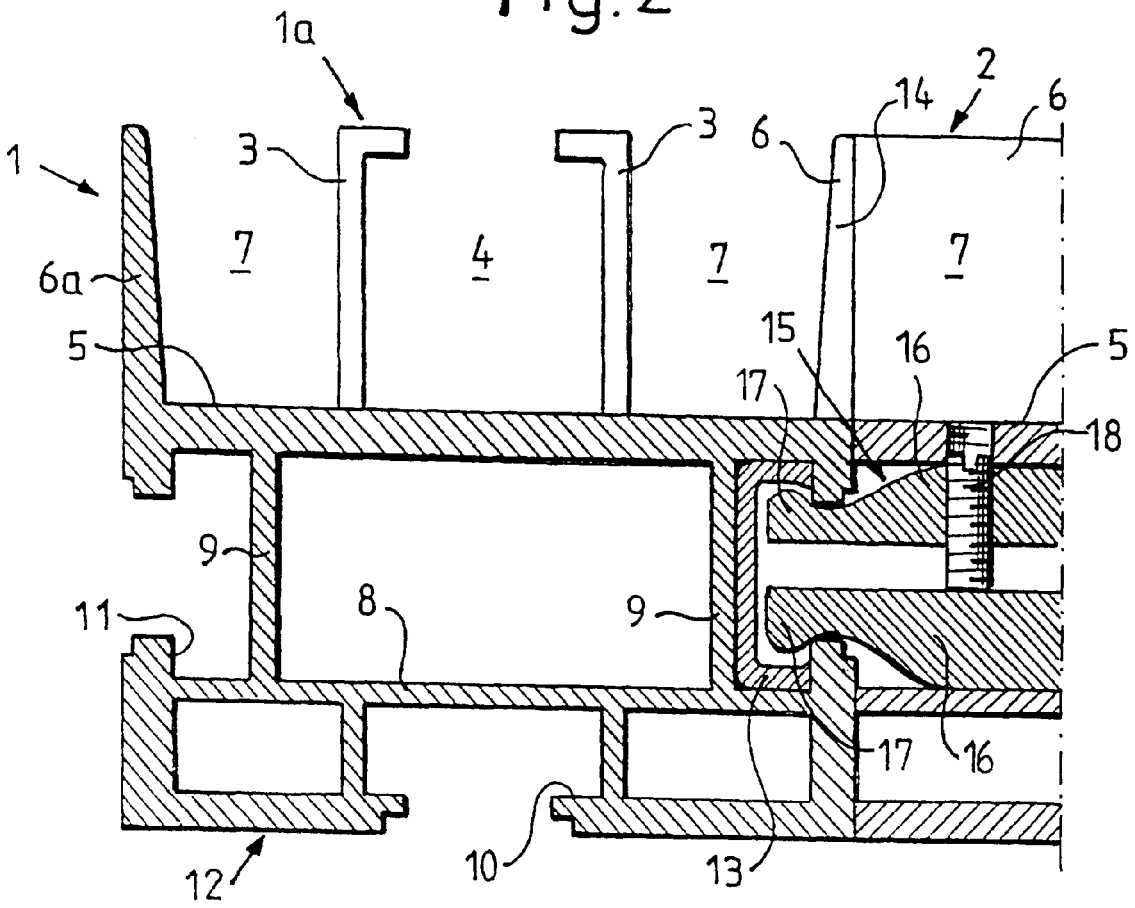
FIG. 2 is a cross-sectional view of a part of a beam construction according to another embodiment of the invention.

The embodiment of the beam construction as shown in FIG. 2 differs from that described above merely by the joint between the first 1 and second 2 beam here being T-shaped. Corresponding parts are here given the same reference numerals as in FIG. 1. The Figure is a cross-section of a first 1 and part of a second 2 beam adjacent to a transition piece 12.

The duct 7 formed in the first beam 1 and positioned to the right in the Figure communicates via an opening 14 in the right-hand side-limiting duct wall 6 of the first beam 1 with the duct 7 of the second beam 2. The opening 14 is formed by the transition piece 12 on the right side having no side-limiting duct wall. It is thus the end of the side-limiting duct wall of the first beam element 1*a* arranged beyond the transition piece 12, that is to be seen the Figure.

On the left side of the transition piece, a side-limiting duct wall 6*a* is arranged. This duct wall is arranged in alignment with the side-limiting duct walls of the two first beam elements and extends along the length of the entire transition piece. In this manner a continuous side-limiting duct wall forms along the entire left side of the first beam. Since no second beam is arranged on the left side of the transition piece 12, a T-shaped joint forms between the first and the second beam in this embodiment.

The Figure also shows how the second beam 2 with its end abuts against the transition piece 12 and the first beam element 1*a* of the first beam. The Figure also shows how the jaws 17 of the locking means 15 cooperate with the right T groove 11 and how the jaws 17 on the legs 16 can be made to move away from each other by turning of the screw 18. If the second beam 2 is to be detached from the first beam, the jaws can of course by opposite turning of the screw 18 be made to approach each other in order to allow removal of the locking means 15 from the T groove 11. To this end, a spring means pressing the legs towards each other can also be arranged in the not shown part of the locking means 15. It appears from the Figure that the sectional element 13 is here so designed as to allow the jaws 17 to be accommodated in the T groove 11 without directly cooperating with these.

Figure 3:
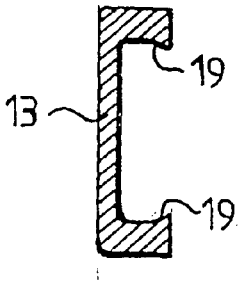
FIG. 3 is a cross-sectional view of a sectional element in a beam construction according to the invention.

FIG. 3 shows an alternative embodiment of the sectional element 13. In this embodiment, the generally U-shaped element 13 has two inwardly directed beads 19. The beads 19 are adapted to cooperate with the jaws 17, such that the sectional element 13, as the jaws are moved apart, is pressed in the direction of the second beam 2 and, owing to the friction against the inside of the T groove 11, is fixed in the longitudinal direction of the first beam.

If necessary, the beam construction can be supplemented with plug means (not shown) in the open ends of the upwardly directed T grooves 4 for preventing the sealant from entering the T grooves. For instance, if the sealant is a substance of low viscosity, such as a liquid, the joints between the various side-limiting duct walls can be provided with joint seals, such as silicone strands or packings.

What is claimed is:

1. A beam construction for ceilings in clean rooms comprising:

at least one first beam and at least one second beam, which are arranged essentially horizontally and perpendicularly to each other, each of said first and second beams defining a longitudinal duct for receiving a liquid or viscous sealant, each of said ducts at least partly being formed of longitudinal walls arranged on the beams, one wall defining a bottom surface of each said duct and two walls defining side-limiting walls of each said duct, wherein at least the first beam includes two or more separately positionable beam elements successively arranged in the longitudinal direction and a transition piece arranged therebetween, wherein said transition piece defines an opening in at least one of said side-limiting duct walls of the first beam, and wherein said at least one second beam sealingly abuts against the transition piece and the first beam elements arranged on each side of the transition piece.

2. A beam construction as claimed in claim 1, wherein the transition piece has a longitudinal side-limiting duct wall, which together with the side-limiting duct walls of the first beam elements forms a continuous side-limiting duct wall, such that said opening forms in only one of the side-limiting duct walls of the joined first beam, one said second beam abutting the opening such that the first and the second beams define a T shape having a correspondingly T-shaped duct portion.

3. A beam construction as claimed in claim 1, wherein the transition piece at least partly is without a side-limiting duct wall on both sides, such that said opening forms in the two opposite side-limiting duct walls of the joined first beam, two said second beams abutting each of the two openings, respectively, such that the first and the second beams constitute as X shape having a correspondingly X-shaped duct portion.

4. A beam construction as claimed in claim 1, wherein the transition piece is made of an extruded material.

5. A beam construction as claimed in claim 1, wherein the transition piece and the first beam element are joined by one of more sectional elements which are inserted into one or more axially extending grooves, which are arranged in the transition piece and in the first beam elements arranged at each end of the transition piece, and that the axial length of the sectional element is greater than that of the transition piece.

6. A beam construction as claimed in claim 5, wherein the sectional element is axially displaceable in the groove.

7. A beam construction as claimed in claim 5, wherein the at least one second beam is joined to the at least one first beam with the aid of locking means, which are axially fixed to the ends of the second beam and which have jaws cooperating with the groove extending axially in the transition piece.

8. A beam construction as claimed in claim 7, wherein the jaws also cooperate with the sectional element arranged in the groove.

9. A beam construction as claimed in claim 2, wherein the transition piece is made of an extruded material.

10. A beam construction as claimed in claim 3, wherein the transition piece is made of an extruded material.

11. A beam construction as claimed in claim 2, wherein the transition piece and the first beam element are joined by one or more sectional elements which are inserted into one or more axially extending grooves, which are arranged in the transition piece and in the first beam elements arranged at each end of the transition piece, and that the axial length of the sectional element is greater than that of the transition piece.

12. A beam construction as claimed in claim 3, wherein the transition piece and the first beam element are joined by one or more sectional elements which are inserted into one or more axially extending grooves, which are arranged in the transition piece and in the first beam elements arranged at each end of the transition piece, and that the axial length of the sectional element is greater than that of the transition piece.

13. A beam construction as claimed in claim 4, wherein the transition piece and the first beam element are joined by one or more sectional elements which are inserted into one or more axially extending grooves, which are arranged in the transition piece and in the first beam elements arranged at each end of the transition piece, and that the axial length of the sectional element is greater than that of the transition piece.

14. A beam construction as claimed in claim 9, wherein the transition piece and the first beam element are joined by one or more sectional elements which are inserted into one or more axially extending grooves, which are arranged in the transition piece and in the first beam elements arranged at each end of the transition piece, and that the axial length of the sectional element is greater than that of the transition piece.

15. A beam construction as claimed in claim 10, wherein the transition piece and the first beam element are joined by one or more sectional elements which are inserted into one or more axially extending grooves, which are arranged in the transition piece and in the first beam elements arranged at each end of the transition piece, and that the axial length of the sectional element is greater than that of the transition piece.

16. A beam construction as claimed in claim 11, wherein the sectional element is axially displaceable in the groove.

17. A beam construction as claimed in claim 12, wherein the sectional element is axially displaceable in the groove.

18. A beam construction as claimed in claim 13, wherein the sectional element is axially displaceable in the groove.

19. A beam construction as claimed in claim 14, wherein the sectional element is axially displaceable in the groove.

20. A beam construction as claimed in claim 6, wherein the at least one second beam is joined to the at least one first beam with the aid of locking means, which are axially fixed to the ends of the second beam and which have jaws cooperating with the groove extending axially in the transition piece.

21. A beam construction as claimed in claim 4, wherein the transition piece is made of aluminum.

22. A beam construction as claimed in claim 9, wherein the transition piece is made of aluminium.

23. A beam construction as claimed in claim 10, wherein the transition piece is made of aluminium.

24. A beam construction as claimed in claim 1, wherein the duct for receiving a liquid or viscous sealant of the first beam and the duct for receiving a liquid or viscous sealant of the second beam are sealingly connected in fluid communication.

* * * * *